US007665957B2

(12) United States Patent
Khanin et al.

(10) Patent No.: US 7,665,957 B2
(45) Date of Patent: Feb. 23, 2010

(54) HEAT SHIELD FOR SEALING A FLOW CHANNEL OF A TURBINE ENGINE

(75) Inventors: Alexander Khanin, Moscow (RU); Edouard Sloutski, Moscow (RU); Alexander Burmistrov, Moscow (RU)

(73) Assignee: Alstom Technology Ltd, Baden (CH)

( * ) Notice: Subject to any disclaimer, the term of this patent is extended or adjusted under 35 U.S.C. 154(b) by 110 days.

(21) Appl. No.: 11/859,963

(22) Filed: Sep. 24, 2007

(65) Prior Publication Data

US 2008/0260524 A1 Oct. 23, 2008

Related U.S. Application Data

(63) Continuation of application No. PCT/EP2006/060903, filed on Mar. 21, 2006.

(30) Foreign Application Priority Data

Mar. 24, 2005 (DE) ..... 10 2005 013 798

(51) Int. Cl.
*F01D 25/26* (2006.01)

(52) U.S. Cl. ..... 415/134; 415/173.1; 415/231

(58) Field of Classification Search ..... 415/110, 415/113, 134, 139, 173.1, 231
See application file for complete search history.

(56) References Cited

U.S. PATENT DOCUMENTS

| | | | | |
|---|---|---|---|---|
| 4,576,548 | A * | 3/1986 | Smed et al. | 415/137 |
| 5,188,506 | A * | 2/1993 | Creevy et al. | 415/115 |
| 5,333,995 | A * | 8/1994 | Jacobs et al. | 415/209.2 |
| 5,423,659 | A * | 6/1995 | Thompson | 415/173.1 |
| 5,630,702 | A | 5/1997 | Marmilic et al. | |
| 5,901,787 | A * | 5/1999 | Boyle | 166/135 |
| 6,315,519 | B1 | 11/2001 | Bagepalli et al. | |
| 6,406,256 | B1 | 6/2002 | Marx | |
| 6,514,041 | B1 | 2/2003 | Matheny et al. | |
| 6,575,697 | B1 | 6/2003 | Arilla et al. | |
| 6,932,566 | B2 * | 8/2005 | Suzumura et al. | 415/135 |
| 7,207,771 | B2 * | 4/2007 | Synnott et al. | 415/173.1 |
| 7,435,049 | B2 * | 10/2008 | Ghasripoor et al. | 415/173.3 |
| 2003/0039542 | A1 * | 2/2003 | Cromer | 415/135 |
| 2005/0056025 | A1 | 3/2005 | Lepretre et al. | |

(Continued)

FOREIGN PATENT DOCUMENTS

| | | | |
|---|---|---|---|
| DE | 4442157 | A1 | 5/1996 |

(Continued)

*Primary Examiner*—Edward Look
*Assistant Examiner*—Aaron R Eastman
(74) *Attorney, Agent, or Firm*—Volpe and Koenig, P.C.

(57) ABSTRACT

A heat shield arrangement for local separation of a flow channel within a turbine engine, with respect to a stator housing radially surrounding the flow channel is provided. The heat shield includes two axially opposite joining contours which are each engageable with two components which are axially adjacent along the flow channel. Each provides a complementary reception contour for the joining contours. At least one of the reception contours has an axial clearance, in which the associated joining contour is axially displaceably mounted. At least one seal is provided between the axially displaceable joining contour and the reception contour. The seal is mounted movably within the reception contour or the joining contour in such a way that the seal is deflectable against a surface region of the reception contour or of the joining contour.

20 Claims, 2 Drawing Sheets

U.S. PATENT DOCUMENTS

| | | | | |
|---|---|---|---|---|
| 2006/0083607 | A1* | 4/2006 | Synnott et al. | 415/173.1 |
| 2007/0025841 | A1* | 2/2007 | Milazar | 415/134 |
| 2008/0267770 | A1* | 10/2008 | Webster et al. | 415/173.1 |

FOREIGN PATENT DOCUMENTS

| | | | |
|---|---|---|---|
| DE | 19938274 | A1 | 2/2001 |
| EP | 0545589 | A1 | 6/1993 |
| EP | 0775805 | A2 | 5/1997 |
| EP | 1099826 | A1 | 5/2001 |
| EP | 1293644 | A1 | 3/2003 |

* cited by examiner

HEAT SHIELD FOR SEALING A FLOW CHANNEL OF A TURBINE ENGINE

CROSS REFERENCE TO RELATED APPLICATION

This application is a continuation of International Application No. PCT/EP2006/060903, filed Mar. 21, 2006, which is incorporated by reference as if fully set forth.

FIELD OF INVENTION

The invention relates to a heat shield for the local separation of a flow channel within a turbine engine, in particular a gas turbine plant, with respect to a stator housing radially surrounding the flow channel, with two axially opposite joining contours which each can be brought into engagement with two components which are axially adjacent along the flow channel and which each provide a complementary reception contour for the joining contours, of which reception contours at least one reception contour has an axial clearance, along which the joining contour joined in it is mounted axially displaceably, at least one seal being provided between the axially displaceable joining contour and the reception contour.

BACKGROUND

Heat shields of the generic type designated above are part of axial-throughflow turbine engines, through which gaseous working media flow for compression or controlled expansion and, because of their high process temperatures, those plant components which are acted upon directly by the hot working media are subject to high thermal loads. Particularly in the turbine stages of gas turbine plants, the rotating blades and guide vanes, arranged axially one behind the other in rotating blade and guide vane rows, are acted upon directly by the hot combustion gases occurring in the combustion chamber. In order to prevent the situation where the hot gases flowing through the flow channel subject to thermal load those regions within the turbine engine which are provided in stator regions facing away from the flow channel, heat shields, as they are known, which are provided on the stator side in each case between two guide vane rows arranged axially adjacently to one another, ensure as gastight a bridge-like sealing as possible between two guide vane rows arranged axially adjacently. Correspondingly designed heat shields may also be provided along the rotor unit, which are in each case mounted on the rotor side between two axially adjacent rotating blade rows, in order to protect corotating rotor components from the introduction of an excessive amount of heat.

Although the following statements refer solely to heat shields which are arranged between two guide vane rows and to that extent can separate and correspondingly protect the stator-side housing and the components connected to it with respect to the heat-loaded flow channel, it is also conceivable to provide the following measures on a heat shield which serves for protecting corotating rotor components and which can be introduced between two rotating blade rows arranged axially adjacently to one another.

FIG. 2*a* illustrates a diagrammatic longitudinal section through a gas turbine stage, into the flow channel of which project radially from outside guide vanes 1 connected to a stator housing S, the special configuration of which has no further significance in what follows.

A rotating blade 2, connected to a rotor unit, not illustrated, projects between two guide vanes 1 arranged adjacently in guide vane rows and is spaced apart radially on the end face with respect to a heat shield 3 which with the guide vane 2 encloses as small a free intermediate gap 4 as possible, in order as far as possible to avoid leakage losses of flow fractions of the hot gas stream through the intermediate gap 4. For this purpose, the rotating blade tip has sealing structures 5 which are arranged so as to rotate freely with respect to what are known as abrasion elements 6.

In order to avoid the situation where hot combustion gases in the region of the heat shield 3, which in a bridge-like manner spans the interspace between two guide vanes 1, 1' arranged axially adjacently to one another, may penetrate into that region of the heat shield 3 which faces radially away from the flow channel, the heat shield 3 provides two axially opposite joining contours 7, 8 which extend axially into corresponding reception contours 9, 10 within the guide vane roots.

The reception contour 9 corresponds to a groove-shaped recess which is designed to be complementary with an exact fit to the joining contour 7 and which is incorporated in the root region of the guide vane 1. The axially opposite joining contour 8 of the heat shield 3 is likewise inserted into a reception contour 10 which is designed to be correspondingly complementary to the outer contour of the joining contour 8 and which is introduced in the root region of the guide vane 1'. However, the reception contour 10 has an axial clearance 11, so that the joining contour 8 is mounted axially slideably in the event of a corresponding operationally induced thermal expansion of the heat shield 3.

For the fluidtight sealing of the heat shield 3 with respect to the respective reception contours 9, 10 in the root regions of the guide vanes 1, 1', seals 12, 13 are provided between the joining contours 7, 8 and the associated reception contours 9, 10. The seals 12, 13 are located each in a groove-shaped recess 14 within the joining contours 7, 8 (see also the illustration of a detail according to FIG. 2*b* of the joining region between the joining contour 8 and the reception contour 10). The seals 12, 13 are preferably manufactured from an elastic sealing material in the form of a round bar, project partially beyond the radially outer boundary surface 16 and fit flush, at least along a joining line, against the surface region 17 of the reception contour 10.

As a result of the sealing action of the seals 12, 13, it is possible, on the one hand, to avoid the situation where hot gases from the flow channel penetrate into the regions facing radially away from the flow channel, to the heat shield 3, and the situation is likewise prevented where cooling air L fed in on the stator side may pass through corresponding leakage points into the flow channel. As already explained initially, the clearance 11 provided in the recess 10 serves for a thermally induced material expansion along the heat shield 3, with the result that the joining contour 8, together with the seal 12 provided in it, is displaced into a position on the right, evident in the illustration. When, by contrast, the gas turbine stage is shut down and the individual components cool down, the joining contour 8, together with the seal 12 provided in it, returns to the original initial position. It is obvious that, due to the thermally induced relative movements between the reception contour 8 and the surface region 17, the seal 12 is subject to material abrasion phenomena which, when a maximum permissible tolerance limit is exceeded, lead to a wear-induced reduction in the sealing function of the seal, so that cooling air L can escape through the intermediate gaps which occur or are already present between the joining contour 8 and reception contour 10. This not only leads to a considerable loss of cooling air, with the result that the cooling action is drastically reduced, but there is also the risk that hot gases may also enter regions which face away from the flow channel with respect to the heat shield 3. In addition, usually seals are used which consist of a fabric material which may be thinned out under excessive mechanical frictional stress, with the result that the sealing action of the seal decreases with increasing operating time.

SUMMARY

The object on which the invention is based is to provide a heat shield for the location separation of a flow channel within a turbine engine, in particular a gas turbine plant, with respect to a stator housing radially surrounding the flow channel, with two axially opposite joining contours which can each be brought into engagement with two components which are axially adjacent along the flow channel and which each provide a complementary reception contour for the joining contours, of which reception contours at least one reception contour has an axial clearance, along which the joining contour joined in it is mounted axially displaceably, at least one seal being provided between the axially displaceable joining contour and the reception contour, in such a way that the seal is to reduce or considerably lower abrasion caused by relative movements between the joining contour and the reception contour which are brought about by the thermally induced material expansions and shrinkages.

In particular, it is appropriate to take measures which considerably reduce the wear of the seals, although the measures to be taken here are to be executable as simply as possible in structural terms. Finally, it is appropriate decisively to prolong the maintenance cycles of the maintenance-subject components on the heat shield, thus with particular regard to the seals, and to improve their operating reliability.

The present invention is a heat shield arrangement for local separation of a flow channel within a turbine engine, with respect to a stator housing radially surrounding the flow channel. The heat shield includes two axially opposite joining contours which are each engageable with two components which are axially adjacent along the flow channel. Each provides a complementary reception contour for the joining contours. At least one of the reception contours has an axial clearance, in which the associated joining contour is axially displaceably mounted. At least one seal is provided between the axially displaceable joining contour and the reception contour. The seal is mounted movably within the reception contour or the joining contour in such a way that the seal is deflectable against a surface region of the reception contour or of the joining contour.

BRIEF DESCRIPTION OF THE DRAWINGS

The invention is described below by way of example, without any restriction of the general idea of the invention, by means of exemplary embodiments, with reference to the drawings in which.

DETAILED DESCRIPTION OF THE PREFERRED EMBODIMENTS

Introduction to the Embodiments

According to the solution, a heat shield is designed, according to the features of the preamble of claim 1, in such a way that the seal is mounted movably within the reception contour or the joining contour in such a way that the seal can be deflected by the action of force against a surface region of the reception contour or of the joining contour.

According to the present invention, the seal, which preferably consists of a metallic material, preferably of an incompressible material, is introduced within a recess along the reception contour or joining contour, but is additionally deflected or pressed against a surface region of the reception contour or joining contour by the action of force, preferably by the action of spring force. The following considerations provide for integrating the seal into the joining contour of the heat shield, so that the seal is pressed by the action of spring force against a surface region of the reception contour. It is likewise also possible, however, to integrate the seal in a corresponding recess provided within the reception contour, so that the seal is pressed against a surface region of the joining contour. The choice of mounting of the seal will be governed by the respective structural conditions of the joining connection between the heat shield and the axially following component of the gas turbine plant. Without any restriction to the general idea of the invention, the seal design according to the invention will be described below as an integral constituent of the joining contour of the heat shield. In this regard, reference is made to the exemplary embodiment described in the Figures.

DETAILED DESCRIPTION

Figure 1A:
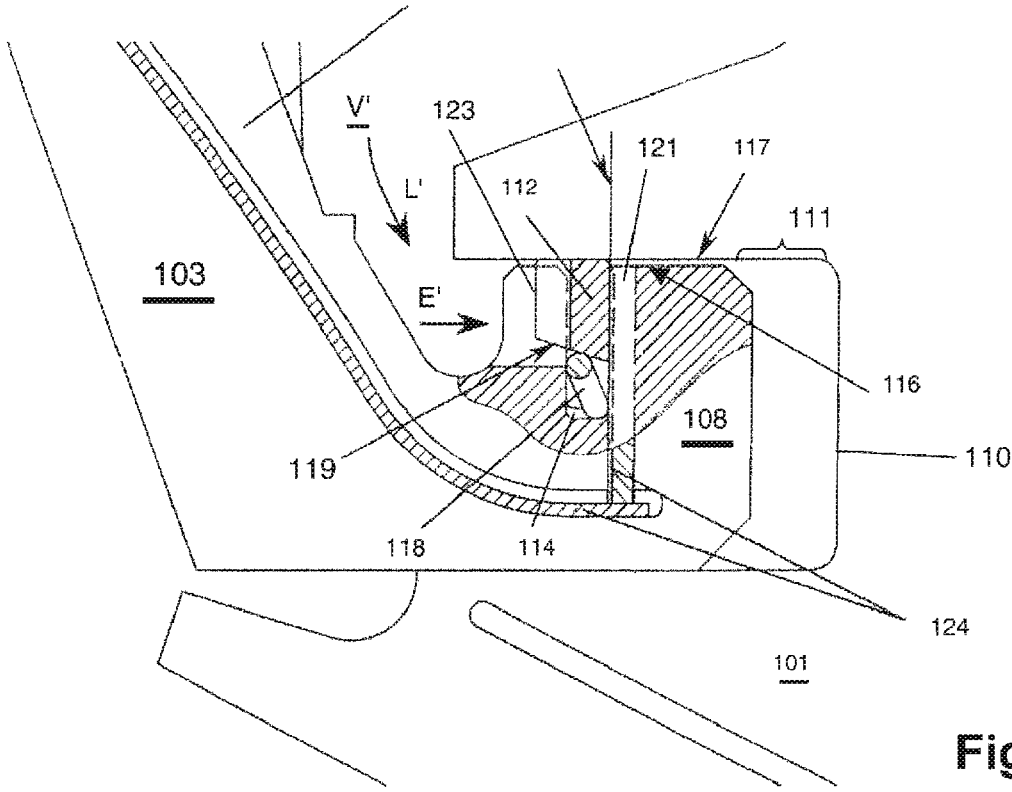
FIG. 1*a* shows a diagrammatic partial longitudinal sectional illustration through a joining region between a heat shield and an axially adjacent guide vane.

FIG. 1*a* shows a partial view of a longitudinal section through a heat shield 103 in the region of the joining contour 108 which issues into a corresponding groove-shaped reception contour 110 of an axially adjacent root of a guide vane 101'. The axial depth of the reception contour 110 is dimensioned, in such a way that, in the case of a thermally induced material expansion of the heat shield 103, the joining contour 108 is mounted slideably along the axially oriented clearance 111. The joining contour 108 consequently executes a translational movement indicated by the direction of the arrow E'. In the exemplary embodiment illustrated in FIG. 1*a*, the joining contour 108 has a radially outer joining face 116 in which a groove-shaped recess 114 is incorporated. The depth of the groove-shaped recess 114, measured from the joining face 116, corresponds at least to the maximum radial extent of the seal 112, the shape of which is adapted to the inner contour of the groove-shaped recess 114, so that the seal 112 can be pushed completely into the recess 114. Furthermore, within the groove-shaped recess 114, a spring element 118 is provided which is introduced between the groove bottom of the recess 114 and the seal 112, so that the spring element 118 can drive the seal 112 radially upward. For a supplementary overview of the design of the seal 112, of the spring element 118 and of the groove-shaped recess 114 within the joining contour 108, reference is made to the perspective illustration according to FIG. 1*b*, which is to be considered below together with FIG. 1*a*.

Figure 1B:
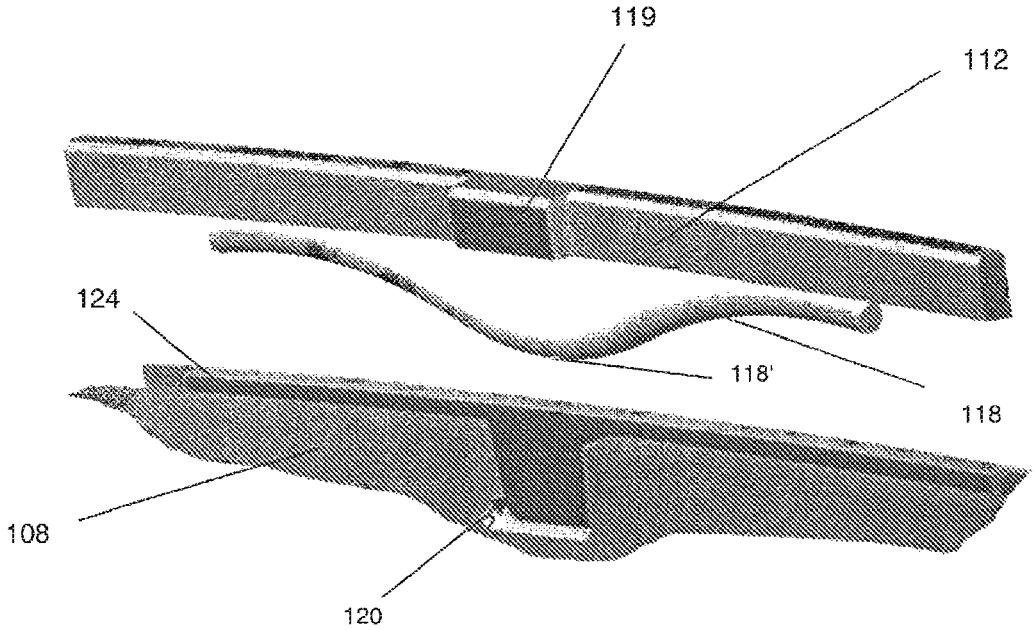
FIG. 1*b* shows a perspective illustration of the sealing element with a spring element in a vertical projection above a recess within the joining contour, FIGS. 2*a, b* show a partial longitudinal sectional illustration through a heat shield with axially adjacent guide vanes and an illustration of a detail relating to this according to the prior art.
Figure 2A:
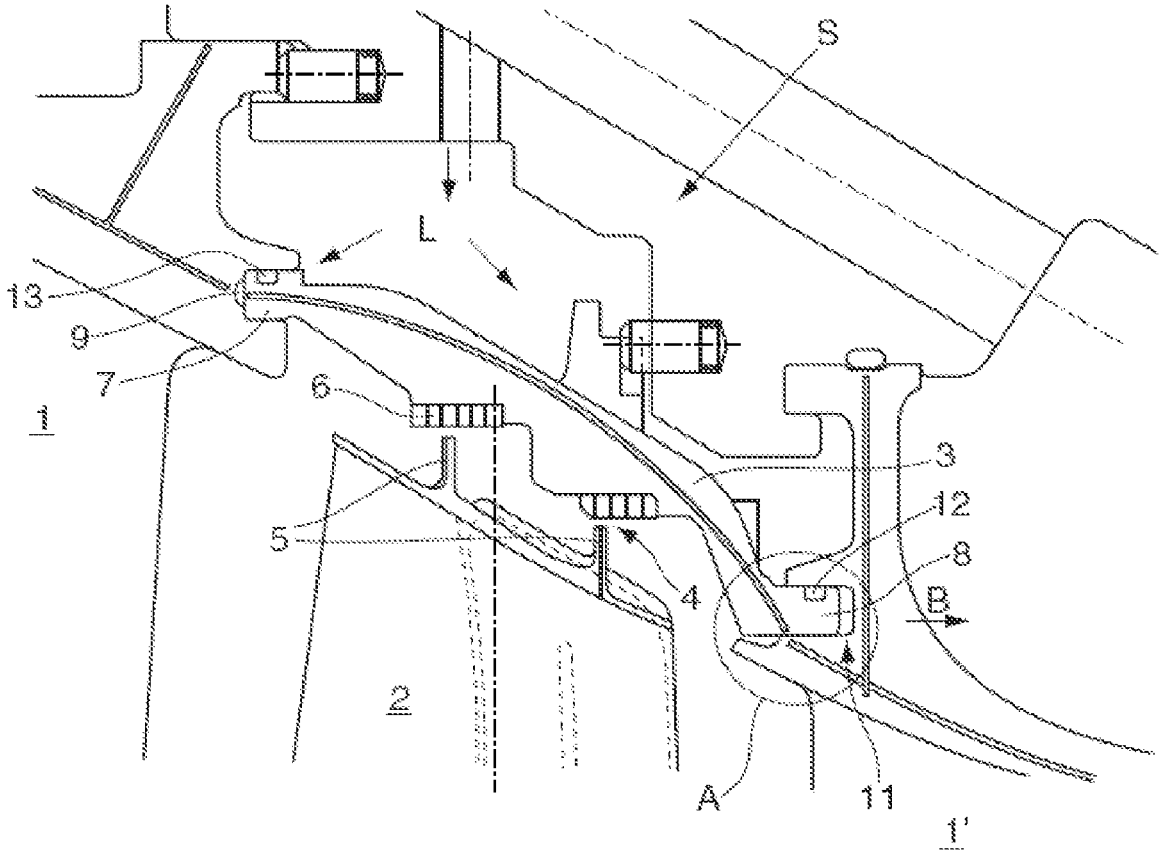
Fig. 2a Prior Art
Figure 2B:
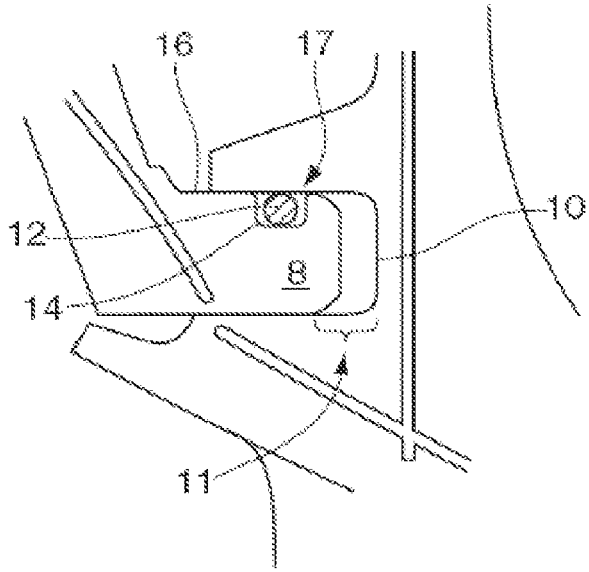
Fig. 2b Prior Art

The seal 112 is designed in the form of a rod in the way illustrated in perspective in FIG. 1*b* and is preferably manufactured from an incompressible metallic material which has essentially no abrasion properties. The seal 112 has centrally a rectangularly formed protrusion 119 which engages into a correspondingly rectangularly formed recess 120 in the inserted state within the groove-shaped recess 114. The seal 112 is positively guided linearly in the radial direction by the protrusion 119, so that the seal 112 is prevented from slipping out of place in the circumferential direction along the groove-shaped recess 114. Between the seal 112 and the bottom of the groove-shaped recess 114, a spring element 118 of curved form is introduced, which can press the seal 112 radially upward by the action of spring force. In order to prevent the spring element 118 from slipping out of place in the circumferential direction along the groove-shaped recess 114, the curved spring element portion 118' facing the groove bottom issues into a corresponding recess disposed in the groove bottom.

The boundary wall 121, axially opposite the rectangularly formed recess 120, within the groove-shaped recess 114 is manufactured from a sealing material and can thereby come into fluidtight contact with the seal 112.

FIG. 1*a* illustrates the inserted state of the joining contour 108 within the reception contour 110, it being evident in the longitudinal sectional illustration illustrated that the spring element 118 presses the seal 112 radially outward against a surface region 117 of the reception contour 110 and therefore presses the heat shield 103 in a fluidtight manner against the reception contour 110 within the root of the guide vane 101'. In order to ensure that the seal 112 is pressed by the action of force both against the surface region 117 and at the rear against the boundary wall 121, the radially lower side edge of the seal 112 is of obliquely inclined design, so that the spring element 118 can also press the seal 112 axially against the rear boundary face 121 in a fluidtight manner.

In order to improve the sealing action of the seal 112 against the surface region 117 of the reception contour 110, the side edge of the seal which faces the surface region 117 is designed to be contour-true with respect to the surface region 117.

Although the sealing system designed according to the present invention cannot avoid the axial longitudinal movements of the heat shield 103 caused by the thermal material expansion or shrinkage, nevertheless, with a suitable choice of the seal material, material abrasion becomes entirely irrelevant, especially since the seal 112 is selected from an incompressible wear-free preferably metallic material which ensures fluidtight sealing on account of the pressure caused by the action of spring force.

It is likewise conceivable to provide the seal arrangement acted upon by spring force alternatively in the region of the reception contour 110, such as, for example, in the region of the boundary face, instead of within the joining contour 108 in the way indicated in FIGS. 1*a* and 1*b*.

Furthermore, the cooling air L' flowing in under high pressure can exert a high pressure force on the axially directed face 123 of the protrusion 119 within the cooling volume V' enclosed by the heat shield 103, so that, in addition to the spring force component, the seal is pressed in the axial direction against the boundary side 121 consisting of sealing material.

In addition to the actual embodiment of the spring element 118 which is illustrated in FIGS. 1*a* and 1*b*, further spring element designs may also be envisaged, such as, for example, a multiplicity of individual helical spring elements helically shaped or coiled spring elements and suitably shaped flat springs.

Moreover, for the sake of completeness, it is pointed out that the heat shield illustrated in FIGS. 1*a* and 1*b* delimits in a ring-like multiple arrangement the entire circumferential region between two guide vane rows arranged adjacently to one another. For this purpose, two heat shields arranged adjacently to one another in the circumferential direction are in engagement via a common strip band seal 124, by means of which a possible loss of cooling air along two heat shields contiguous to one another in the circumferential direction can be avoided.

The sealing arrangement according to the invention thus affords the following advantages:

The leaktightness of the cooling air volume which is separated from the flow channel by the heat shield is considerably improved by virtue of the wear-free seal, especially since the sealing action is ensured, despite thermal expansion and shrinkage phenomena, by the seal being pressed by the action of spring force against the respective surface region lying opposite the seal.

Regardless of predetermined tolerance dimensions in terms of the design of the reception contour or of the joining contour, the pressing of the seal caused by spring force ensures at any time a sealing of the joining region with respect to its radially upper and lower boundary faces, especially since the radially upper seal 112, by virtue of the counterforce exerted on the joining region, can also press the radially lower boundary face of the joining region against the boundary face of the reception contour 110 in a fluidtight manner. Should the seal be provided in the region of the boundary face, the same applies accordingly.

Due to the pressing action of the seal 112 against the surface region 116 of the reception contour 110 by the action of spring force, the spring element 118, because of its inherent elasticity, contributes to a certain capacity for the absorption of shocks or vibrations, so that mechanical vibrations occurring within the joining region can be absorbed by the spring element 118 and therefore do not subject the joining region to excessively high mechanical stress.

LIST OF REFERENCE SYMBOLS

| | |
|---|---|
| 1, 1', 101' | Guide vane |
| 2 | Rotating blade |
| 3, 103 | Heat shield |
| 4 | Intermediate gap |
| 5 | Ribs |
| 6 | Abrasion elements |
| 7, 8, 108 | Joining contour |
| 9, 10, 110 | Reception contour |
| 11, 111 | Axial clearance |
| 12, 13, 112 | Seal |
| 114 | Groove-shaped recess |
| 15 | N/A |
| 16, 116 | Joining face |
| 17, 117 | Surface region |
| 118 | Spring element |
| 118' | Part region of the spring element |
| 119 | Protrusion |
| 120 | Recess |
| 121 | Boundary face |
| 123 | Radial side face of the protrusion |
| 124 | Strip band seal |

What is claimed is:

1. A heat shield arrangement for local separation of a flow channel within a turbine engine, with respect to a stator housing radially surrounding the flow channel, the heat shield comprising two axially opposite joining contours which are each engageable with two components which are axially adjacent along the flow channel and which each provide a complementary reception contour for the joining contours, at least one of the reception contours has an axial clearance, in which the associated joining contour is axially displaceably mounted, at least one seal being provided between the axially displaceable joining contour and the reception contour, the seal is mounted movably within the reception contour or the joining contour in such a way that the seal is deflected against a surface region of at least one of the reception contour or of the joining contour, the joining contour including a joining face in which is introduced for the seal a recess out of which the seal is deflectable so as to project partially beyond the joining face into a gap defined between the reception contour surface region and the joining face.

2. The heat shield as claimed in claim 1, wherein at least one of the reception contour or the joining contour has a joining face in which is introduced for the seal a recess out of which the seal is deflectable so as to project partially beyond the joining face.

3. The heat shield as claimed in claim 2, wherein at least one spring element, that deflects the seal by the action of spring force, is provided in the recess.

4. The heat shield as claimed in claim 3, wherein the at least one spring element is designed as a curved bar spring and is held in the longitudinal direction with respect to the recess.

5. The heat shield as claimed in claim 3, wherein the recess has a radially oriented boundary face which consists of a sealing material, the seal has a radially upper side edge which is adapted to the surface region against which the seal can be pressed, and the seal has a radially lower sloped side edge, against which the spring element presses, and an inclination of the slope is selected in such a way that the seal can be pressed both against the surface region and against the boundary face consisting of the sealing material.

6. The heat shield as claimed in claim 3, wherein the seal is comprised of a metallic material.

7. The heat shield as claimed in claim 3, wherein the seal is an incompressible solid body.

8. The heat shield as claimed in claim 3, wherein the seal is bar-shaped and has a local protrusion along its extent, and the joining contour comprises a recess, which is adapted to the protrusion and along which the protrusion is guided in the radial direction, is provided in the recess.

9. The heat shield as claimed in claim 2, wherein the seal is bar-shaped and has a local protrusion along its extent, and the joining contour comprises a recess, which is adapted to the protrusion and along which the protrusion is guided in the radial direction, is provided in the recess.

10. The heat shield as claimed in claim 2, wherein the seal deflectable by spring force against the surface region of at least one of the reception contour or of the joining contour.

11. The heat shield as claimed in claim 2, wherein the seal is comprised of a metallic material.

12. The heat shield as claimed in claim 2, wherein the seal is an incompressible solid body.

13. The heat shield as claimed in claim 1, wherein the seal deflectable by spring force against the surface region of at least one of the reception contour or of the joining contour.

14. The heat shield as claimed in claim 13, wherein at least one spring element, that deflects the seal by the action of spring force, is provided in the recess.

15. The heat shield as claimed in claim 13, wherein the seal is comprised of a metallic material.

16. The heat shield as claimed in claim 13, wherein the seal is an incompressible solid body.

17. The heat shield as claimed in claim 13, wherein the seal is bar-shaped and has a local protrusion along its extent, and the joining contour comprises a recess, which is adapted to the protrusion and along which the protrusion is guided in the radial direction, is provided in the recess.

18. The heat shield as claimed in claim 1, wherein the seal is comprised of a metallic material.

19. The heat shield as claimed in claim 18, wherein the seal is an incompressible solid body.

20. The heat shield as claimed in claim 1, wherein the seal is an incompressible solid body.

* * * * *